US008827432B2

(12) United States Patent
Mizutani et al.

(10) Patent No.: US 8,827,432 B2
(45) Date of Patent: Sep. 9, 2014

(54) CARTRIDGE

(71) Applicant: Seiko Epson Corporation, Tokyo (JP)

(72) Inventors: Tadahiro Mizutani, Nagano (JP); Izumi Nozawa, Nagano (JP); Hiroyuki Nakamura, Nagano (JP); Atsushi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/951,560

(22) Filed: Jul. 26, 2013

(65) Prior Publication Data

US 2014/0218448 A1 Aug. 7, 2014

(30) Foreign Application Priority Data

Feb. 7, 2013 (JP) ..... 2013-022028

(51) Int. Cl.
*B41J 2/175* (2006.01)

(52) U.S. Cl.
USPC ..... 347/86

(58) Field of Classification Search
USPC ..... 347/84–87
See application file for complete search history.

(56) References Cited

U.S. PATENT DOCUMENTS

| | | | | |
|---|---|---|---|---|
| 2003/0122909 | A1* | 7/2003 | Ogura et al. | 347/86 |
| 2004/0165044 | A1* | 8/2004 | Yamada | 347/86 |
| 2008/0204526 | A1 | 8/2008 | Pearson et al. | |
| 2009/0167827 | A1* | 7/2009 | Usui et al. | 347/86 |

* cited by examiner

*Primary Examiner* — Kristal Feggins
(74) *Attorney, Agent, or Firm* — Global IP Counselors, LLP

(57) ABSTRACT

A cartridge is equipped with an ink chamber provided on the interior of a case, and a supply port for supplying ink housed in the ink chamber to a printer. A porous member for leading the ink is provided in the supply port. A through hole for having the interior of the case and the outside communicate is provided on the case. A ventilation path that connects a space S on the supply port interior and the through hole is provided on the case interior. The meniscus pressure resistance of the porous member is greater than the absolute value of the difference between the pressure applied to the inside of the porous member when ink is led via the porous member, and the pressure applied to inside the ventilation path when ink is led via the porous member.

5 Claims, 13 Drawing Sheets

CARTRIDGE

CROSS-REFERENCE TO RELATED APPLICATIONS

This application claims priority to Japanese Patent Application No. 2013-022028, filed on Feb. 7, 2013. The entire disclosure of Japanese Patent Application No. 2013-022028 is expressly incorporated by reference herein.

TECHNICAL FIELD

The present invention relates to a cartridge and the like.

BACKGROUND ART

With a cartridge that houses printing material supplied to a printing device, for example, cartridges for supplying ink as one example of a printing material to an inkjet printer as one example of a printing device are known. With this kind of cartridge, normally, an ink supply port for supplying ink to the outside is provided. As modes of the supply port, various items are known, but as an example of this, items are known for which a porous member is provided by which ink inside a chamber is transferred to the inkjet printer (see U.S. Patent Application Publication No. 2008/204526, for example). As with U.S. Patent Application Publication No. 2008/204526, with a cartridge that leads ink via the porous member, there are cases when the space of the supply port interior is made to communicate with air. By having the space of the supply port interior communicate with air, for example when the supply port is blocked, such as when the cartridge is mounted in the printer, for example, even if the air existing in the space of the supply port interior is expanded by a temperature change or the like, the expanded portion of air is released to the outside, so it is possible to suppress to a low level the pressure fluctuation in the space of the supply port interior. Also, when the supply port is blocked such as when the cartridge is mounted in the printer or the like, even in a case such as when the air existing in the space of the supply port interior is rapidly compressed, the compressed air is released to the outside, so it is possible to suppress to a low level the pressure fluctuation in the space of the supply port interior. In this way, if it is possible to suppress to a low level the pressure fluctuations in the space of the supply port interior, it is possible to prevent the air existing in this space from flowing into the chamber via the porous member, or flowing into the inkjet printer. With the cartridge of U.S. Patent Application Publication No. 2008/204526, an opening is provided on the porous member. This opening is connected to a ventilation path provided on the cartridge interior, and this ventilation path is connected to an air communication port. Specifically, with the cartridge of this publication, the space of the supply port interior is in communication with the air via the opening provided on the porous member, the ventilation path provided on the cartridge interior, and the air communication port.

SUMMARY

However, with the cartridge of U.S. Patent Application Publication No. 2008/204526, the porous member is in contact with air at the opening part. Thus, when ink is led via the porous member, it is easy for air to be drawn into the interior of the porous member. When air is drawn into the interior of the porous member, the air that is drawn in mixes into the ink by dissolving into the ink or mixing with the ink as air bubbles.

There are cases when the air mixed into the ink flows into the inkjet printer, and appears as air bubbles in the path up to reaching the recording head, or in the interior of the recording head. When air bubbles mix in with the ink inside the recording head, there are cases when the ink discharge performance decreases due to the air bubbles. Examples of decreased discharge performance include the volume of ink drops being outside the prescribed range, ink drops not being discharged, the ink drop moving direction being skewed or the like.

Specifically, with the cartridge equipped with the supply port of the kind of constitution noted above, when the porous member is in contact with air, when printing material is led via the porous member, there is a possibility of air mixing into the printing material.

The present invention was created to address at least a portion of the problems described above, and is realized as the following modes or application examples.

One application example of the present invention is a cartridge, comprising a printing material chamber provided in the case interior, and a supply port for supplying printing material housed in the printing material chamber to a printing device. A porous member for leading the printing material is provided on the supply port. A through hole that allows the interior of the case to be in communication with the outside is provided on the case. A ventilation path that connects the space of the supply port interior with the through hole is provided on the interior of the case. The meniscus pressure resistance of the porous member is greater than the absolute value of the difference between the pressure applied to the inside of the porous member when the printing material is led via the porous member and the pressure applied to the inside of the ventilation path when the printing material is led via the porous member.

With the cartridge of this application example, the space of the supply port interior passes through to the outside of the case via the ventilation path and the through hole. By doing this, it is possible to suppress the pressure fluctuation of the space in the supply port interior to a low level, and it is possible to prevent the air that exists in this space from flowing into the inside of the chamber via the porous member, or flowing into the printing device. Furthermore, with this cartridge, the meniscus pressure resistance is greater than the absolute value of the difference between the pressure applied to the inside of the porous member when the printing material is led via the porous member and the pressure applied to the inside of the ventilation path when the printing material is led via the porous member. In other words, the meniscus formed on the porous member withstands the pressure applied to the interface of the porous member and the air when the printing material is led via the porous member. Because of this, even when the printing material is led via the porous member, it is possible to reduce the possibility of having air mix into the printing material via the contact part of the porous member and air.

With the cartridge noted above, in the interior of the case, it is also possible to have the printing material chamber and the ventilation path be separated from each other.

With this application example, in the interior of the case, the printing material chamber and the ventilation path are separated from each other, so it is easy to avoid having printing material inside the printing material chamber leak out to outside the case via the ventilation path.

With the cartridge noted above, it is also possible to have a sheet member having flexibility be provided between the printing material chamber and the ventilation path, and to have the printing material chamber and the ventilation path be separated by the sheet member.

With this application example, it is possible to form at least a portion of the printing material chamber using a sheet member having flexibility, so it is easy to reduce the capacity of the printing material chamber according to a decrease in printing material. Because of that, it is possible to reduce the pressure fluctuation inside the printing material chamber when the printing material has decreased.

With the cartridge noted above, it is also possible to have a ventilation hole that allows the ventilation path interior to communicate with the printing material chamber, and a valve for opening and closing the ventilation hole, and to have the valve be constituted so as to normally close the ventilation hole, and to separate from the ventilation hole only when the capacity of the printing material chamber is decreased to a prescribed value, and for air on the interior of the ventilation path to be introduced into the printing material chamber when the valve is separated from the ventilation port.

With this application example, when the capacity of the printing material chamber decreases, it is possible to introduce air inside the ventilation path via the valve to the printing material chamber. By doing this, it is possible to reduce the pressure fluctuation inside the printing material chamber.

With the cartridge noted above, on the inside of the printing material chamber, it is also possible to have a second porous member for holding the printing material be provided in a state with a gap open in relation to at least a portion of a wall demarcating the printing material chamber, and to have the ventilation path be constituted by the gap inside the chamber, and a second meniscus pressure resistance of the second porous member be the same or greater than the sum of the pressure applied to the inside of the second porous member when the printing material is led from the supply port, and the pressure applied to the gap when the printing material is led from the supply port.

With this application example, the second porous member provided inside the chamber is in contact with air in the ventilation path. The second meniscus pressure resistance with the second porous member is the same or greater than the sum of the pressure applied to the inside of the second porous member when liquid is led from the supply hole and the pressure applied to the gap when liquid is led from the supply hole. In other words, the meniscus formed on the second porous member can withstand the pressure applied when the printing material is led from the supply port. Because of this, it is possible to reduce the possibility of air being mixed into the printing material via the contact part of the second porous member and the air when the printing material is led.

DETAILED DESCRIPTION OF THE EMBODIMENTS

Figure 1:
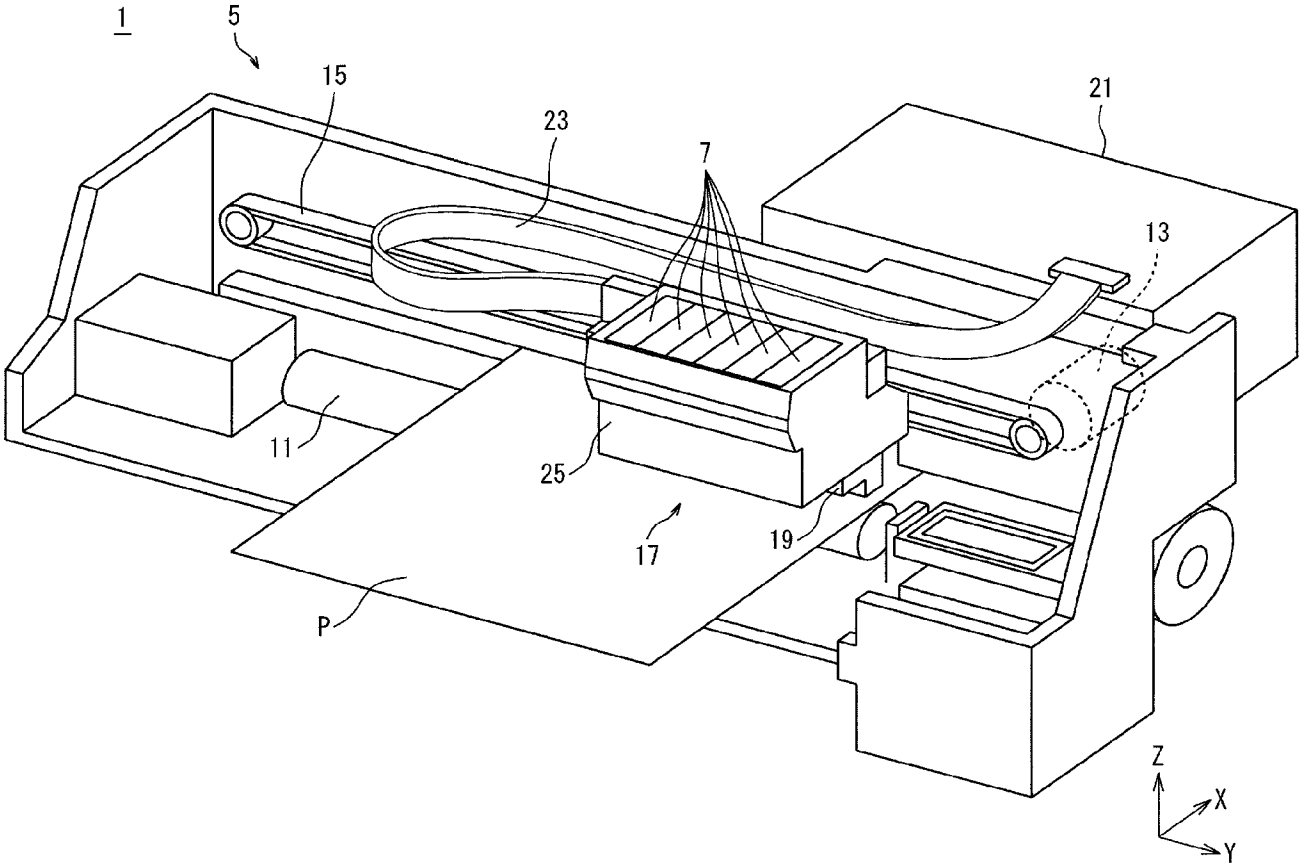
FIG. 1 is a perspective view showing the constitution of the inkjet printer of this embodiment.

We will describe an embodiment with an inkjet printer as an example while referring to the drawings. With each drawing, to make the size of a level for which each constitution can be visually recognized, there are cases when the constitution or member scale differ.

Inkjet Printer Constitution

As shown in FIG. 1, the inkjet printer 1 has a printer 5, and a cartridge 7 as an example of a printing material chamber for housing ink as a printing material. The XYZ axes that are mutually orthogonal coordinate axes other are depicted in FIG. 1. The XYZ axes are also added as necessary in drawings hereafter. With FIG. 1, the printer 5 is arranged on a horizontal plane prescribed by the X axis direction and the Y axis direction. The Z axis direction is the direction orthogonal to the horizontal plane, and the Z axis negative direction is the vertical downward direction.

The printer 5 has a sub scan feed mechanism, a main scan feed mechanism, and a head drive mechanism. The sub scan feed mechanism conveys printing paper P in the sub scan direction using a paper feed roller 11 that uses a paper feed motor (not illustrated) for power. The main scan feed mechanism moves a carriage 17 connected to a drive belt 15 back and forth in the main scan direction using a carriage motor 13 for power. The main scan direction of the printer 5 is the Y axis direction, and the sub scan direction is the X axis direction. The head drive mechanism drives the print head 17 equipped on the carriage 17, and executes discharging of ink as the printing material and dot formation. The printer 5 is further equipped with a control unit 21 for controlling each of the mechanisms described above. The print head 19 is connected to the control unit 21 via a flexible cable 23.

The carriage 17 is equipped with a holder 25 and the print head 19. The holder 25 is constituted so that a plurality of cartridges 7 can be mounted, and is arranged on the top side of the print head 19. With this embodiment, one each of six types of cartridge 7 including black, yellow, magenta, cyan, light magenta, and light cyan are mounted in the holder 25. The six cartridges 7 are respectively adapted to be attached and detached with the holder 25. The types of cartridge 7 are not limited to the six types noted above, and any other type can also be used. Also, the number of cartridges 7 that can be mounted in the holder 25 is not limited to six, and any number of one or more can be used. The print head 19 functions as a printing material ejection section for ejecting ink by discharging ink.

Figure 2:
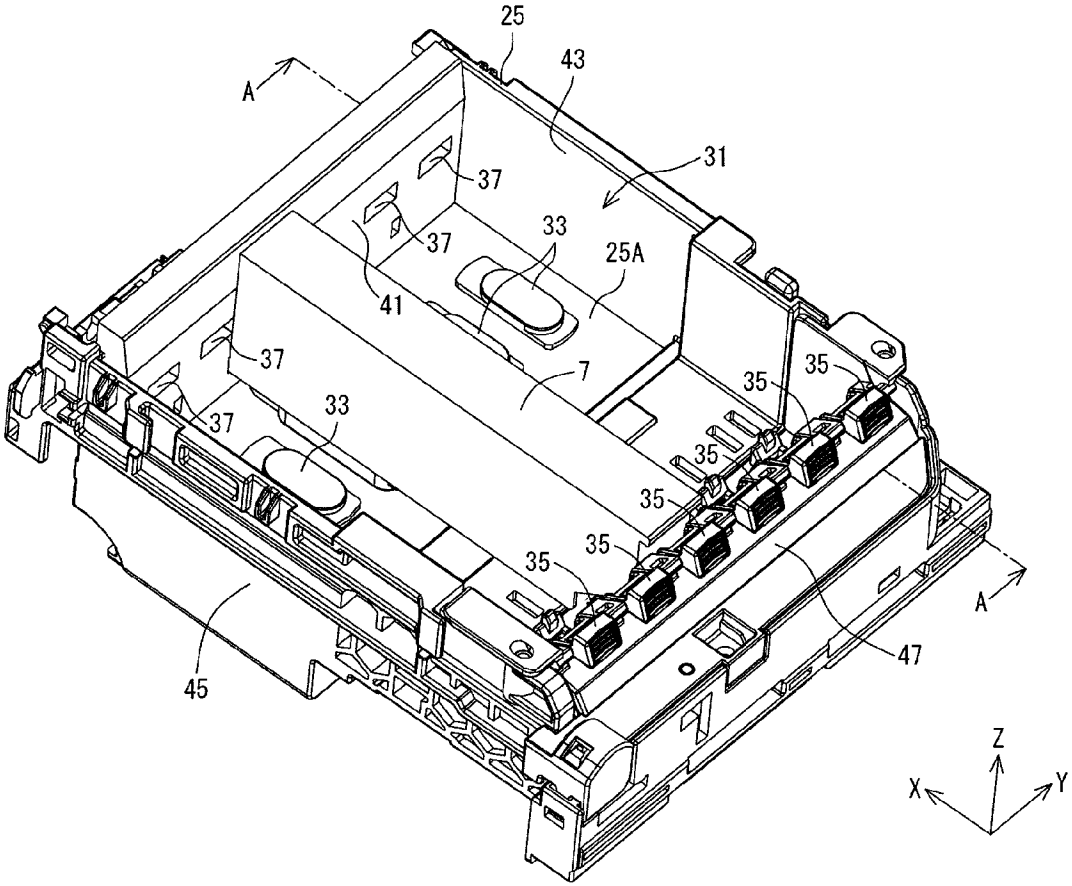
FIG. 2 is a perspective view showing the constitution of the holder of this embodiment.

As shown in FIG. 2, the holder 25 has a recess 31. The cartridge 7 is mounted inside the recess 31 of the holder 25. With this embodiment, it is possible to house six cartridges 7 inside the recess 31. With this embodiment, the six cartridges 7 mounted inside the recess 31 are housed inside the recess 31 in a state with a gap opened between them. Inside the recess 31, the respective corresponding mounting positions of the six cartridges 7 mounted in the recess 31 are prescribed. The six mounting positions are aligned in the Y axis direction inside the recess 31. In other words, the six cartridges 7 are housed inside the recess 31 in a state aligned in the Y axis direction.

Inside the recess 31, six printing material introduction portions 33 for which ink is introduced as the printing material from the cartridges 7 are provided on a bottom part 25A of the holder 25. The six printing material introduction portions 33 are respectively provided on each mounting position. In other words, the six printing material introduction portions 33 are respectively provided corresponding to the respective six cartridges 7 mounted inside the recess 31. Because of this, the six printing material introduction portions 33 are aligned in the Y axis direction inside the recess 31. Then, the six cartridges 7 mounted in the holder 25 are aligned along the Y axis direction inside the recess 31. With FIG. 2, a state is shown with one cartridge 7 mounted in the holder 25.

Also, six levers 35 and six engagement holes 37 are provided in the holder 25. With this embodiment, for each cartridge 7 mounting position, one lever 35 and one engagement hole 37 is provided. The six levers 35 are aligned in the Y axis direction. The six engagement holes 37 are also aligned in the Y axis direction.

The levers 35 are provided at the −X axis direction side of the printing material introduction portion 33. With the holder 25, a side wall 41 is provided at the side opposite the lever 35 (+X axis direction side) sandwiching the printing material introduction portion 33. Also, a side wall 43 and a side wall 45 are provided at the respective positions confronting in the Y axis direction sandwiching the printing material introduction portions 33. The side wall 43 is positioned at the +Y axis direction side of the bottom part 25A. The side wall 45 is positioned at the −Y axis direction side of the bottom part 25A. Also, a side wall 47 is provided at the position confronting the side wall 41 sandwiching the lever 35 in the Y axis direction. The side wall 41, the side wall 43, the side wall 45, and the side wall 47 respectively project in the +Z axis direction from the bottom part 25A. The bottom part 25A is enclosed by the side wall 41, the side wall 43, the side wall 45, and the side wall 47. By doing this, the recess 31 is demarcated.

Figure 3:
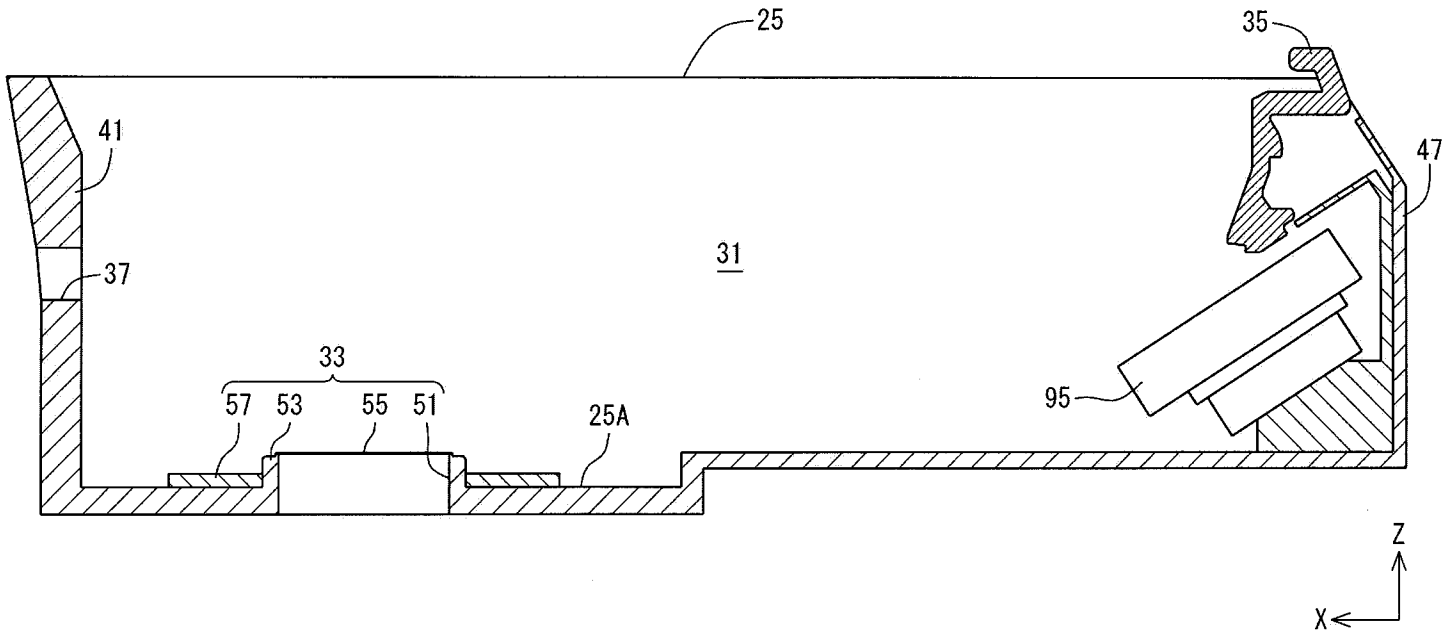
FIG. 3 is a cross section view of line A-A in FIG. 2.

As shown in FIG. 3 which is a cross section view of line A-A in FIG. 2, the lever 35 is provided between the side wall 47 and the side wall 41. FIG. 3 correlates to a cross section view when the holder 25 is cut at the XZ plane that pierces through the printing material introduction port 33. The lever 35 is provided between the side wall 47 and the printing material introduction portion 33. The lever 35 fixes the cartridge 7 mounted in the holder 25. By canceling the fixing of the cartridge 7 by the lever 35, the operator is able to remove the cartridge 7 from the holder 25. The engagement hole 37 is provided on the side wall 41. The engagement hole 37 pierces through the side wall 41.

The printing material introduction portion 33 is provided on the bottom part 25A. The position of the printing material introduction portion 33 in the X axis direction is closer to the side wall 41 of the opposite side than the lever 35. The printing material introduction portion 33 includes a flow path 51, a cylindrical portion 53, a filter 55, and packing 57. The flow path 51 is a path for ink supplied from the cartridge 7. The cylindrical portion 53 is provided on the bottom part 25A, and projects facing the direction that is convex facing the +Z axis direction from the bottom part 25A. The cylindrical portion 53 encloses the flow path 51. The filter 55 is provided so as to cover the opening of the cylindrical portion 53. Specifically, it is provided so as to cover the entry port of the flow path 51. The filter 55 is attached using thermal welding or the like to the opening edge of the cylindrical portion 53. The packing 57 is provided on the bottom part 25A, and encloses the cylindrical portion 53. The packing 57 is constituted with a material having elasticity such as rubber, an elastomer or the like, for example.

First Embodiment

We will describe the cartridge 7 of the first embodiment.

Cartridge Constitution

Figure 4:
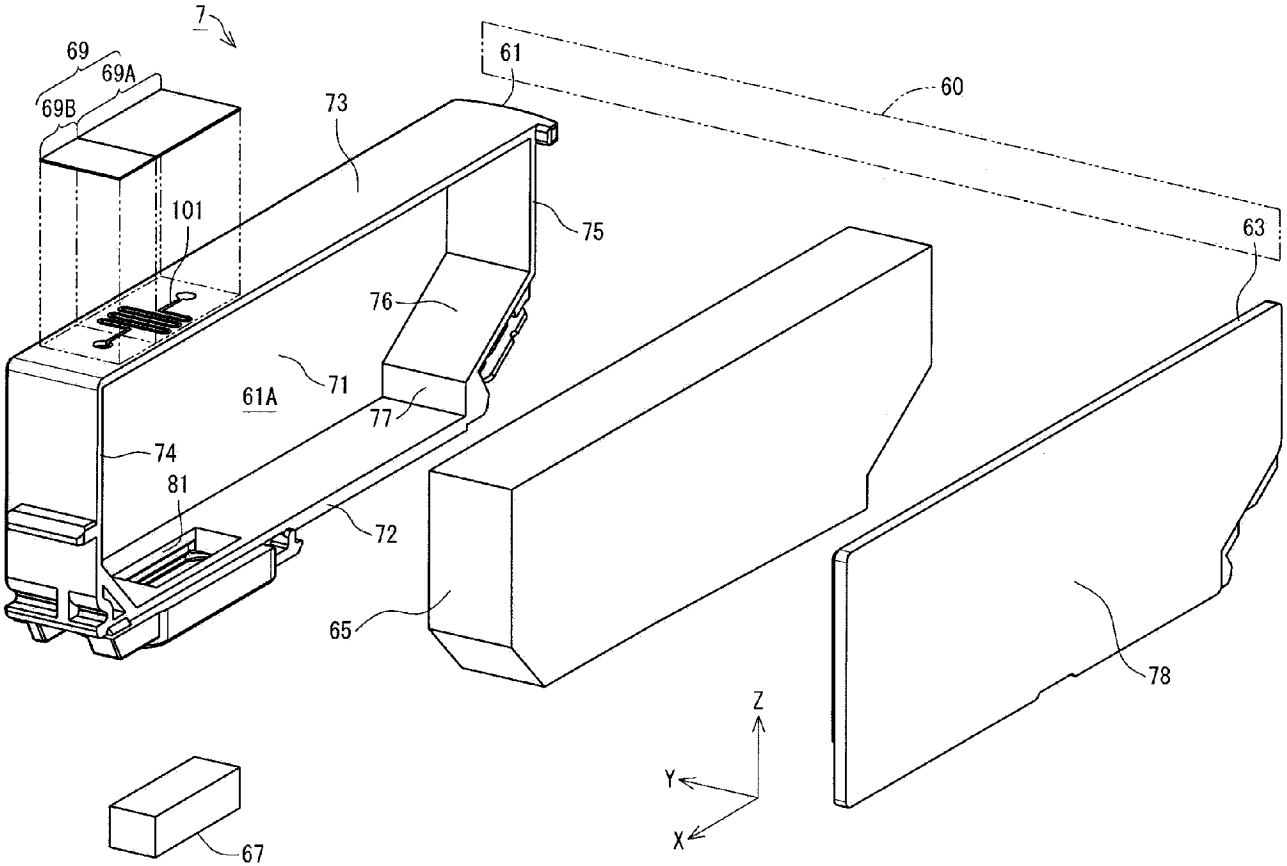
FIG. 4 is a perspective view showing the constitution of the cartridge of the first embodiment.

As shown in FIG. 4, the cartridge 7 of the first embodiment has a case 60, a first foam 65, a second foam 67, and a sheet member 69. The case 60 of the cartridge 7 is constituted by a case main body 61 and a lid member 63. The case 60 has a first wall 71 and an eighth wall 78 facing opposite in the Y axis direction. The first wall 71 is positioned at the +Y axis direction side and the eighth wall 78 is positioned at the −Y axis direction side. The first wall 71 is constituted by the case main body 61, and the eighth wall 78 is constituted by the lid member 63. Also, the case 60 has walls 72 through 77 that intersect the first wall 71 and the eighth wall 78. These walls 72 through 77 are constituted by the case main body 61. Also, the walls 72 through 77 respectively face in the −Y axis direction side from the first wall 71, specifically, project toward the lid member 63 side from the first wall 71. Of these walls, the second wall 72 and the third wall 73 face opposite in the Z axis direction. The second wall 72 is positioned at the −Z axis direction side, and the third wall 73 is positioned at the +Z axis direction side. In a state with the cartridge 7 mounted in the printer 5, the second wall 72 becomes the bottom wall and the third wall 73 becomes the top wall. The fourth wall 74 and the fifth wall 75 face opposite in the X axis direction. The fourth wall 74 is positioned at the +X axis direction side, and the fifth wall 75 is positioned at the −X axis direction side.

The second wall 72 and the third wall 73 are provided at mutually confronting positions sandwiching the first wall 71 in the Z axis direction. The fourth wall 74 and the fifth wall 75 are provided at mutually confronting positions sandwiching the first wall 71 in the X axis direction. The fourth wall 74 and the fifth wall 75 respectively intersect the third wall 73. Also, the fourth wall 74 intersects the second wall 72 at the side opposite the third wall 73 side.

The sixth wall 76 intersects the fifth wall 75 at the second wall 72 side of the fifth wall 75 in the Z axis direction, specifically, at the side opposite the third wall 73 side of the fifth wall 75. The seventh wall 77 intersects the sixth wall 76 at the side opposite the fifth wall 75 side of the sixth wall 76. Also, the seventh wall 77 intersects the second wall 72 at the side opposite the fourth wall 74 side of the second wall 72. The sixth wall 76 slants respectively in relation to the fifth wall 75 and the second wall 72. The sixth wall 76 slants in the direction approaching the fourth wall 74 as it nears the second wall 72 side from the third wall 73 side.

The first wall 71 is enclosed by the second wall 72 through the seventh wall 77. The second wall 72 through the seventh wall 77 project facing the −Y axis direction from the first wall 71. Because of that, the case main body 61 is constituted as a recess shape by the second wall 72 through the seventh wall 77 with the first wall 71 as the bottom part. A recess 61A is constituted by the first wall 71 through the seventh wall 77. The recess 61A is constituted facing with the +Y axis direction as the direction that is recessed. The recess 61A is open facing the −Y axis direction, specifically, facing the lid member 63 side.

The first foam 65 shown in FIG. 4 is housed inside the recess 61A. The first foam 65 is constituted using a material that can absorb ink. As the material of the first foam 65, it is possible to use a porous member such as a sponge, felt or the like, for example. The ink is housed inside the recess 61A in a state absorbed in the first foam 65.

A lid member 63 is provided at a position confronting the first wall 71, sandwiching the second wall 72 through the seventh wall 77 in the Y axis direction. The lid member 63 covers the recess 61A. The case main body 61 and the lid member 63 are joined to each other. With this embodiment, the case main body 61 and the lid member 63 are joined by welding. By doing this, the lid member 63 seals the recess 61A in which the first foam 65 is housed.

In this way, with this embodiment, by the first foam 65 in which ink is absorbed being housed inside the space formed by the case main body 61 recess 61A and the lid member 63, an ink chamber 70 (see FIG. 7 and FIG. 8) is formed inside the case 60.

Figure 5A:
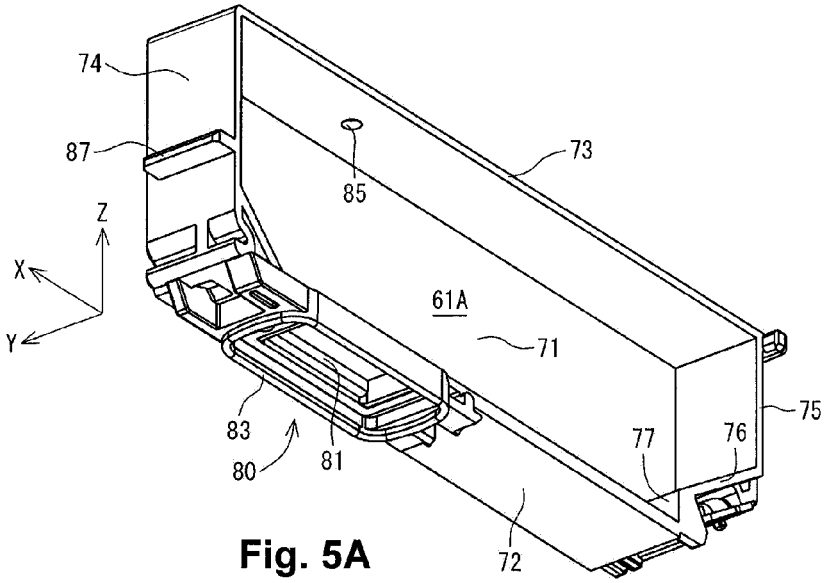
FIGS. 5A and 5B are perspective views showing the case of the first embodiment.
Figure 5B:
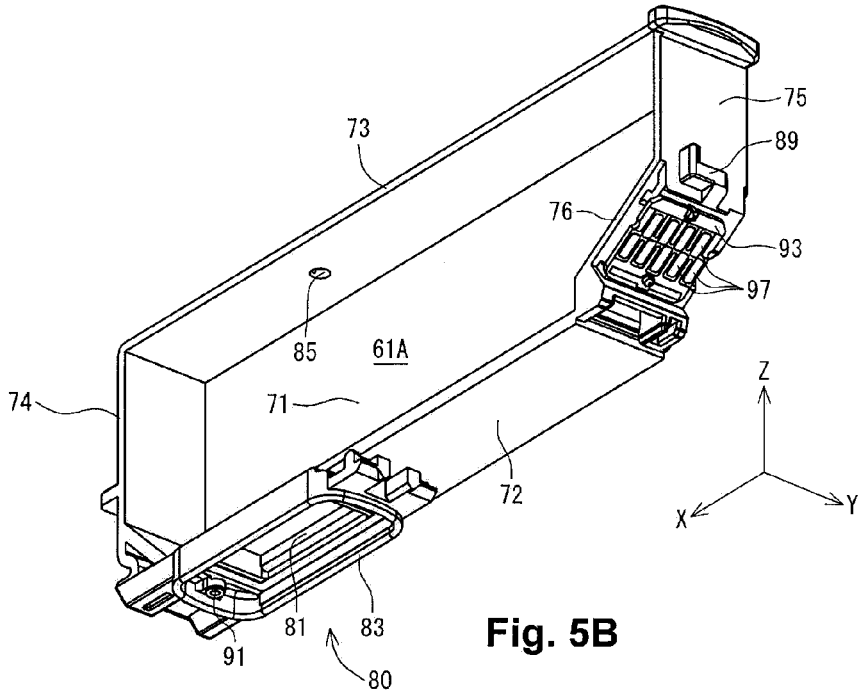
Figure 6A:
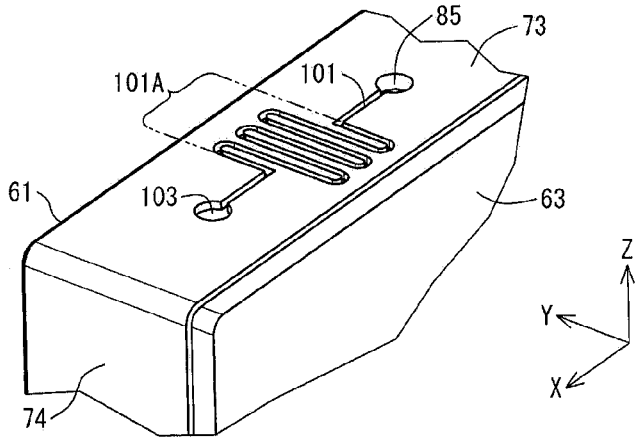
FIGS. 6A, 6B and 6C are perspective views showing the communication path of the first embodiment.
Figure 6B:
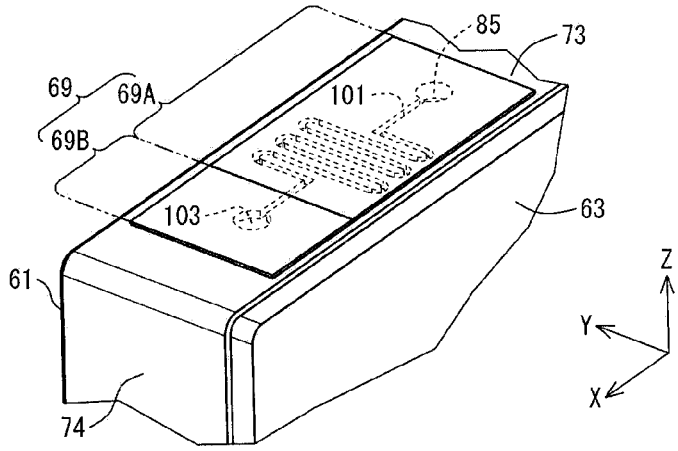

As shown in FIG. 5A, FIG. 5B, and FIG. 6A, a through hole 85 that pierces through the inside and the outside of the case 60 is provided on the third wall 73. Also, as shown in FIG. 6A, a groove 101 is provided on the outer surface of the third wall 73. Then, a sheet member 69 covers the through hole 85 and the groove 101. The groove 101 has a meandering part 101A. The groove 101 reaches a ventilation port 103 after meandering using the meandering part 101A with the through hole 85 as the starting point. The ventilation port 103 is constituted as a recess provided on the outer surface of the third wall 73. The ventilation port 103 and the through hole 85 are connected by the groove 101. In the state before the cartridge 7 is used, as shown in FIG. 6B, the through hole 85, the groove 101, and the ventilation port 103 are sealed by the sheet member 69.

Figure 6C:
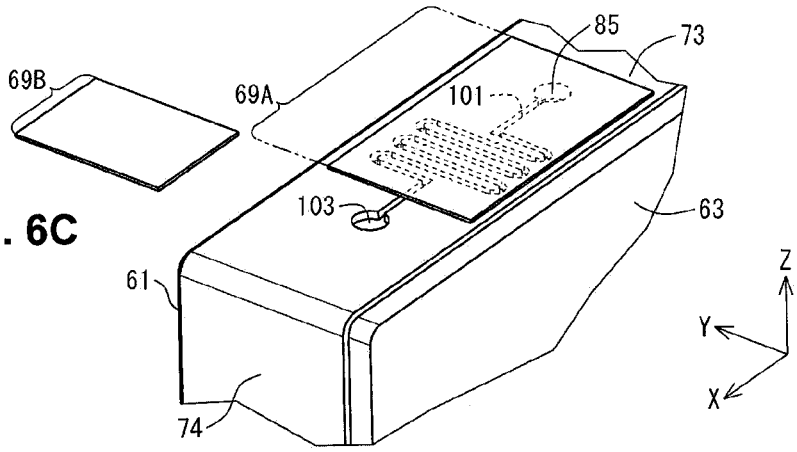

The sheet member 69 is divided into a seal part 69A and a peel part 69B. The seal part 69A, of the area from the through hole 85 to the ventilation port 103, is provided across the area including the through hole 85 and the meandering part 101A. The peel part 69B, of the area from the ventilation port 103 to the through hole 85, is provided across the area from the ventilation port 103 to just before the meandering part 101A. As shown in FIG. 6C, the peel part 69B is peeled by the user when using the cartridge 7. By doing this, the ventilation port 103 is exposed, and the interior of the case 60 is opened to air via the groove 101 and the through hole 85 covered by the sheet member 69. Specifically, with this embodiment, the air communication path is constituted by a combination of the ventilation port 103, the groove 101, and the through hole 85 provided on the third wall 73, and the sealing part 69A of the sheet member 69. The sheet member 69 and the groove 101 are not absolutely essential, and if the through hole 85 is directly exposed to air, it is possible to open the interior of the case 60 to air. However, with this embodiment, the through hole 85 is not directly exposed to air, and is blocked by the sheet member 69. Furthermore, the through hole 85 and the ventilation port 103 are connected via the connection path formed by the groove 101 having the meandering part 101A being blocked by the sheet member 69. In this way, by not having the through hole 85 directly exposed to air, it is possible to reduce the evaporation of ink from the ink chamber. Also, by providing a connection path between the through hole 85 and the ventilation port 103, even in a case when ink leaks out from the through hole 85, it is possible to trap the leaked ink, particularly with the meandering part 101A of this connection path.

Figure 7:
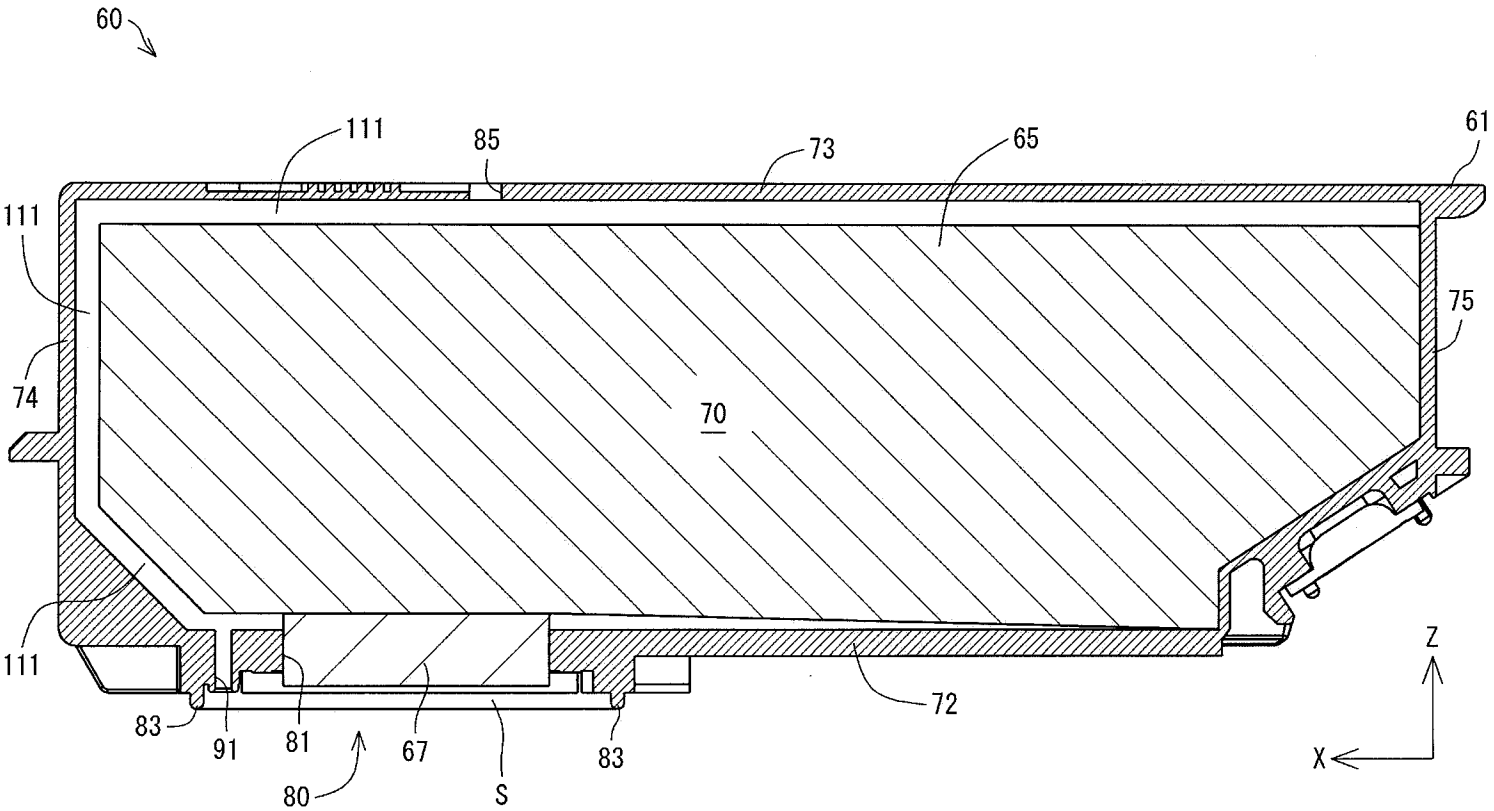
FIG. 7 is a cross section view when the cartridge of the first embodiment is cut at the XZ plane.

As shown in FIG. 5A, FIG. 5B, and FIG. 7, an ink supply port 80 is provided on the second wall 72. The ink supply port 80 is equipped with a supply hole 81 provided so as to pierce through the second wall 72, a peripheral wall 83 provided above the outer surface of the second wall 72, and a second foam 67. The peripheral wall 83 projects facing the opposite side (−Z axis direction side) of the third wall 73 side from the second wall 72. The peripheral wall 83 encloses the supply hole 81 and the second foam 67 from the outside. The second foam 67 is fit into the supply hole 81. The second foam 67 is constituted using a material that can absorb ink. As the material for the second foam 67, for example, it is possible to use a porous member such as a sponge, felt or the like. The ink absorbed in the first foam 65 is exhausted to the outside of the cartridge 7 moving from the first foam 65 to the second foam 67, and is introduced to the printing material introduction portion 33 of the printer (see FIG. 2 and FIG. 3). Specifically, the second foam 67 functions as a porous member that transfers the ink housed in the ink chamber 70 to the printer 5 (FIG. 1).

As shown in FIG. 7, a communication hole 91 is provided on the interior of a space S of the inside of the peripheral wall 83 of the second wall 72, and in the area outside the supply hole 81. This communication hole 91 has the space S on the inside of the peripheral wall 83 communicate with the interior of the case 60. On the interior of the case 60, a gap is further opened between the first foam 65 and a portion of the inner wall of the case 60. In specific terms, a gap is opened between the first foam 65 and the fourth wall 74, and between first foam 65 and the third wall 73. Also, the communication hole 91 is not blocked by the first foam 65, but rather is connected to this gap. This gap is connected to the space S on the inside of the peripheral wall 83 via the communication hole 91, and is connected to the outside of the case 60 via the through hole 85. Specifically, this gap functions as a ventilation path 111 that connects the space S on the inside of the peripheral wall 83 and the through hole 85. A detailed description of the function of the ventilation path 111 will be given later.

A projecting part 87 is provided on the fourth wall 74. The projecting part 87 projects facing the side opposite the fifth wall 75 side from the fourth wall 74 (+X axis direction side). The projecting part 87 is positioned between the second wall 72 and the third wall 73 in the Z axis direction. The projecting part 87 engages with the engagement hole 37 shown in FIG. 3 in a state with the cartridge 7 mounted in the holder 25. Also, as shown in FIG. 5B, a projecting part 89 is provided on the fifth wall 75. The projecting part 89 projects facing the side opposite the fourth wall 74 side from the fifth wall 75 (−X axis direction side). The projecting part 89 is latched by the lever 35 shown in FIG. 3 in a state with the cartridge 7 mounted in the holder 25. By doing this, it is possible to fix the cartridge 7 to the holder 25.

As shown in FIG. 5B, a circuit substrate 93 is attached on the side opposite the recess 61A side of the sixth wall 76, specifically, above the outer surface of the sixth wall 76. The same as with the sixth wall 76, the circuit substrate 93 is also tilted respectively in relation to the second wall 72 and the fifth wall 75. The circuit substrate 93 has its surface, specifically the surface that is the side opposite to the sixth wall 76 side, tilted so as to face the −Z axis direction and the −X axis direction. A plurality of terminals 97 that contact a contact mechanism 95 (FIG. 3) of the holder 25 are provided on the surface of the circuit substrate 93. On the back surface of the circuit substrate 93, specifically on the surface of the sixth wall 76 side, a storage device (not illustrated) such as a non-volatile memory or the like is provided. Of the plurality of terminals 97, at least a portion are electrically connected to this storage device.

In a state with the cartridge 7 mounted in the holder 25, the plurality of terminals 97 are in contact with the contact mechanism 95 shown in FIG. 3. The contact mechanism 95 is electrically connected to the control unit 21 via the flexible cable 23 (FIG. 1). Then, by the contact mechanism 95 and the cartridge 7 storage device being electrically connected via the circuit substrate 93, it is possible to transmit various types of information between the control unit 21 and the cartridge 7 storage device.

Figure 8:
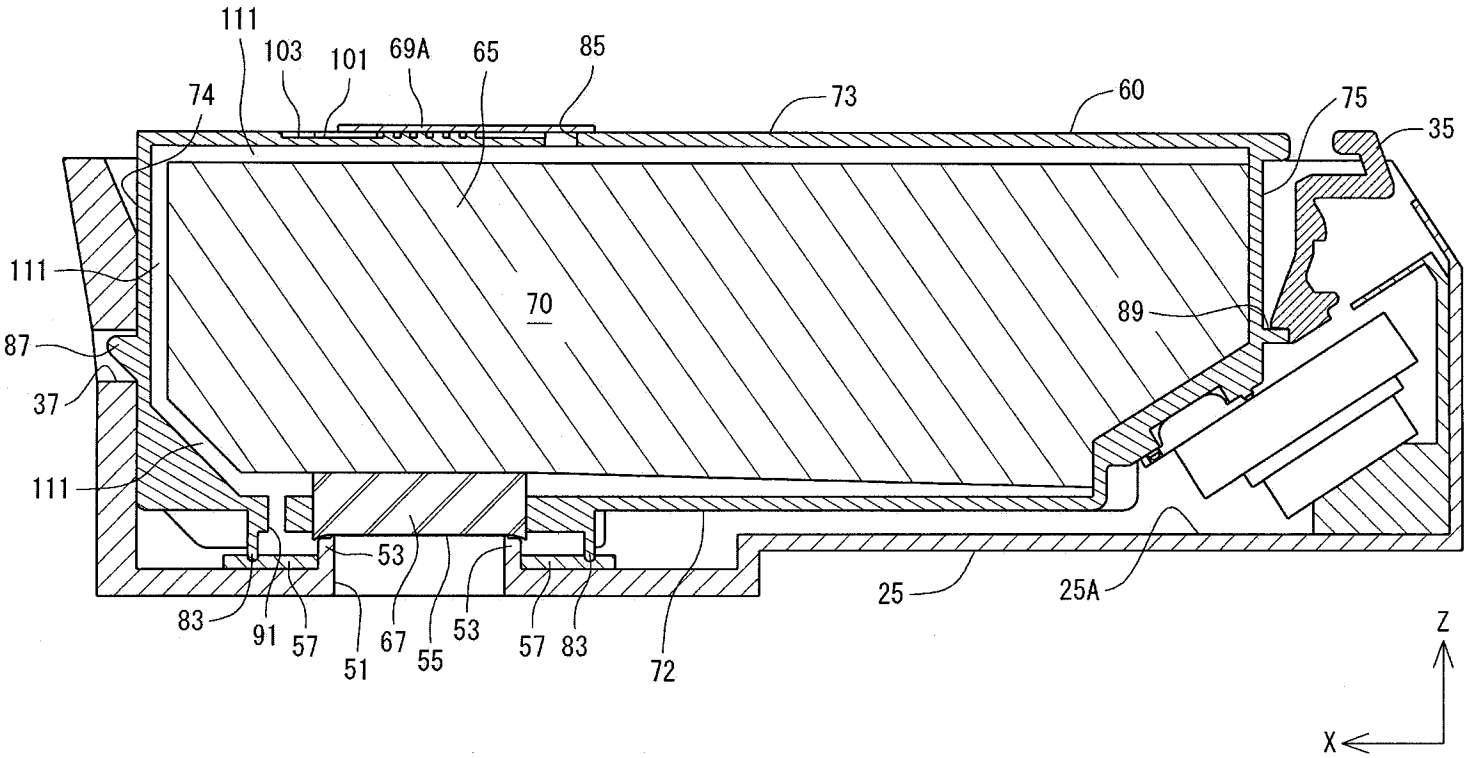
FIG. 8 is a drawing showing the state when the cartridge of the first embodiment is mounted in the holder.

As shown in FIG. 8, the cartridge 7 having the constitution noted above has its position fixed by the lever 35 in a state mounted in the holder 25. When the cartridge 7 is mounted in the holder 25, the cartridge 7 ink supply port 80 and the printer 5 printing material introduction portion 33 are connected. At this time, the peripheral wall 83 of the ink supply port 80 abuts the packing 57 of the printing material introduction portion 33, and the cylindrical portion 53 of the printing material introduction portion 33 is inserted inside the space enclosed by the peripheral wall 83. In other words, the peripheral wall 83 encloses the flow path 51 of the printing material introduction portion 33 from further outside than the cylindrical portion 53. Then, inside the space enclosed by the peripheral wall 83, the second foam 67 contacts the filter 55 of the printing material introduction portion 33. By doing this, the ink absorbed in the first foam 65 inside the recess 61A is supplied to the flow path 51 from the first foam 65 via the second foam 67 and the filter 55.

At this time, the peripheral wall 83 abuts the packing 57 in a state enclosing the cylindrical portion 83. Because of this, when the ink is supplied from the cartridge 7 to the printer 5, even if ink spills to the outside of the cylindrical portion 53, it is held back by the packing 57 and the peripheral wall 83.

Also, with this embodiment, the communication hole 91 is provided inside the space S on the inside of the peripheral wall 83. As described using FIG. 7 previously, the communication hole 91 is connected to the ventilation path 111, and the ventilation path 111 is connected to outside the case 60 via the through hole 85. Specifically, the space S on the inside of the peripheral wall 83 communicates with air via the ventilation path 111. By doing this, the following kinds of effects are exhibited.

For example, in a state with the opening end of the peripheral wall 83 blocked such as when the cartridge 7 is mounted in the printer 5 as shown in FIG. 8, or when a cap is attached to the ink supply port 80 of the cartridge 7 in an unused state or the like, there are cases when the air that exists inside the space S on the inside of the peripheral wall 83 expands due to temperature changes or the like. With this embodiment, even in this kind of case, since the expanded portion of air is released to outside via the ventilation path 111, it is possible to suppress to a low level the pressure fluctuations inside the space S on the inside of the peripheral wall 83.

Also, for example, when the opening end of the peripheral wall 83 is suddenly blocked such as when the cartridge 7 is mounted in the printer 5, when a cap is attached to the ink supply port 80 of the cartridge 7 which has been removed from the printer 5 or the like, there are cases when the air inside the space S on the inside of the peripheral wall 83 is suddenly compressed. With this embodiment, even in this kind of case, since the compressed air is released to outside, it is possible to suppress to a low level the pressure fluctuations inside the space S on the inside of the peripheral wall 83.

In this way, if it is possible to suppress to a low level the pressure fluctuations inside the space S on the inside of the peripheral wall 83, the air inside this space S flows into the inside of the ink chamber 70 via the second foam 67, and it is possible to prevent it from flowing into the printer 5.

Furthermore, with this embodiment, the meniscus pressure resistance P at the second foam 67 is set at a value greater than the absolute value of the difference between the pressure PA applied to the inside of the second foam 67 when ink is led via the second foam 67, and the pressure PB applied to inside the ventilation path 111 when ink is led via the second foam 67. Specifically, with this embodiment, the meniscus pressure resistance P is set to a value that satisfies the relationship of equation (1) noted below.

$$P > |PA - PB| \quad (1)$$

In specific terms, with this embodiment, the meniscus pressure resistance P of the second foam 67 is set to 4.0 kPa, and this value is greater than the absolute value of the difference between pressure PA and pressure PB. The effect of this is described in detail hereafter.

With this embodiment, the maximum value of the flow volume of ink led to the printing material introduction portion 33 (FIG. 2) of the printer 5 from the ink supply port 80 of the cartridge 7 is set to 20 ml/minute. With this ink flow volume maximum value, a pressure loss of 1 kPa occurs inside the second foam 67 by the ink being led. In other words, with this embodiment, when ink is led via the second foam 67, the pressure PA applied inside the second foam 67 is 1.0 kPa.

Also, with this embodiment, with the maximum value of the ink flow volume, a pressure loss of 0.2 kPa occurs inside the ventilation path 111 by the ink being led. In other words, with this embodiment, the pressure PB applied inside the ventilation path 111 when ink is led via the second foam 67 is 0.2 kPa.

From the above, with this embodiment, when ink is led via the second foam 67, pressure PT derived by formula (2) noted below is applied to the interface of the foam 67 and the air.

$$PT = |PA - PB| \quad (2)$$

With this embodiment, the pressure PT is 0.8 kPa. The meniscus pressure resistance P with the second foam 67 is 4.0 kPa, and this is greater than the pressure PT (0.8 kPa). Thus, with this embodiment, even with the maximum value of the ink flow volume, it is possible to keep the meniscus of the ink with the second foam 67. Specifically, when ink is led via the second foam 67, even when pressure is applied to the interface (contact part) of the second foam and the air, the ink meniscus does not break easily. Thus, it is possible to prevent air from flowing in from this part.

In this way, with this embodiment, the meniscus pressure resistance P of the second foam 67 is greater than the absolute value of the difference between the pressure PA applied to the inside of the second foam 67 when ink is led via the second foam 67, and the pressure PB applied to inside the ventilation path 111 when ink is led via the second foam 67. By doing this, when ink is led via the second foam 67, it is possible to reduce the possibility of air mixing into the ink via the contact part of the second foam 67 and the air. Also, as a result, it is possible to maintain a high discharge performance of the ink at the print head 19 of the printer 5, and possible to improve the printing quality.

Second Embodiment

We will describe the cartridge 7A of the second embodiment. With the second embodiment, for constitutions that are the same as the first embodiment, the same code numbers as the first embodiment will be given, and a detailed description will be omitted.

Cartridge Constitution

Figure 9:
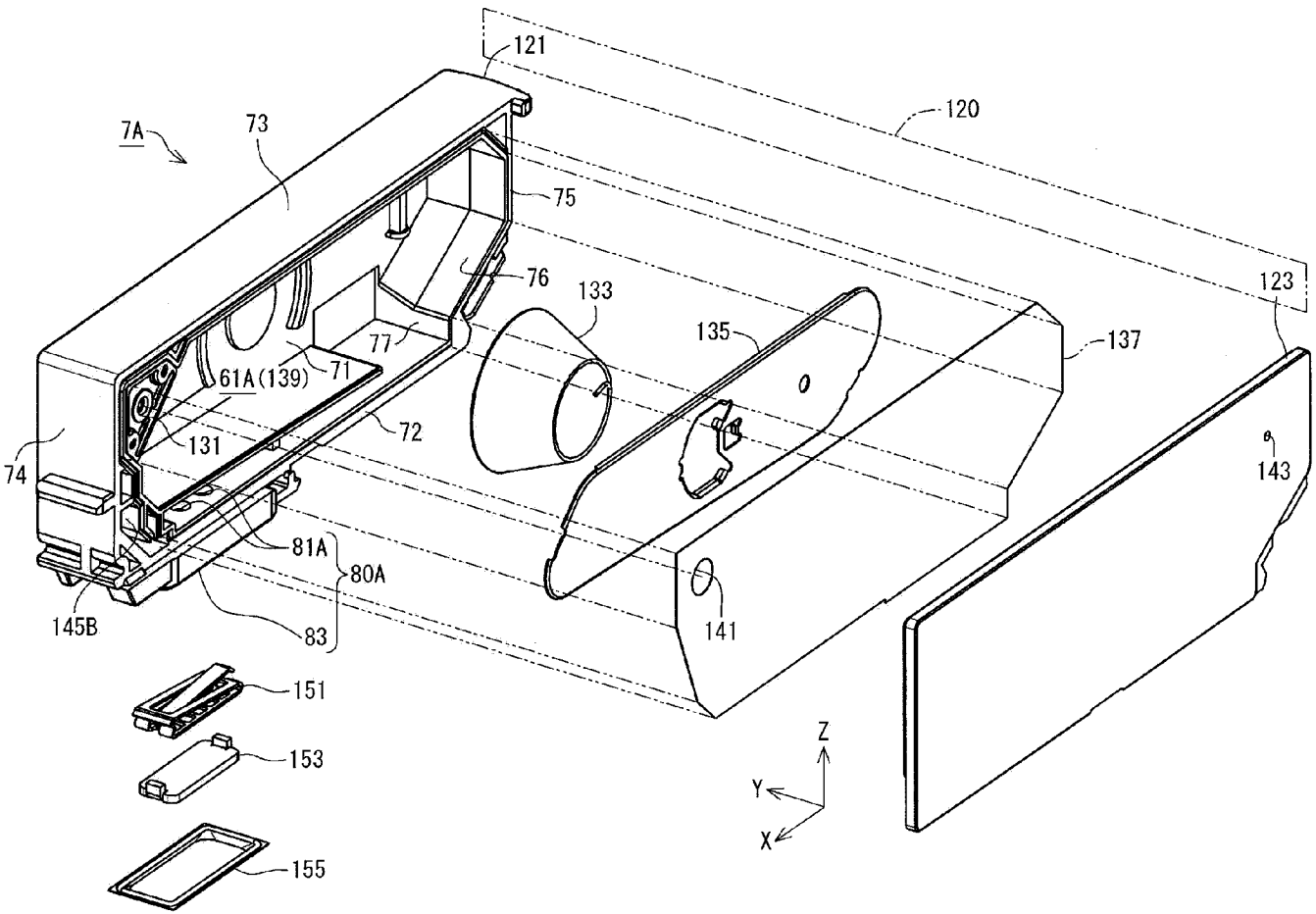
FIG. 9 is a perspective view showing the constitution of the cartridge of the second embodiment.

As shown in FIG. 9, the cartridge 7A of the second embodiment has a case 120 constituted by a case main body 121 and a lid member 123. With the first embodiment, the ventilation port 103, the groove 101, the through hole 85, the sheet member 69 and the like were provided on the third wall 73, but with this embodiment, a through hole 143 is provided on the lid member 123. The through hole 143 puts the interior of the case 120 and the outside in communication. Also, with this embodiment, a sheet member 137 is provided between the lid member 123 and the recess 61A of the case main body 121. The space between the lid member 123 and the sheet member 137 is put in communication with air by the through hole 143, so this space is called air chamber 145A.

With the cartridge 7A of the second embodiment, a valve unit 131, a coil spring 133, and a pressure receiving plate 135 are provided on the interior of the recess 61A. With the first embodiment, the opening of the recess 61A was blocked by the lid member 63 (see FIG. 3), but with this embodiment, the opening of the recess 61A is blocked by the sheet member 137. Then, the lid member 123 is joined to the case main body 121 so as to cover the sheet member 137 while forming a space with the sheet member 137. The sheet member 137 is formed using synthetic resin (e.g. nylon, polypropylene or the like). With this embodiment, the area enclosed by the recess 61A and the sheet member 137 becomes an ink chamber 139. The sheet member 137 has flexibility, and its capacity can change along with consumption of the ink inside the chamber 139. The sheet member 137 is joined to the case main body 121 in a state pushed and extended along the inner wall of the recess 61A in advance so as to easily follow the changes in the capacity of the chamber 139.

The coil spring 133 provided inside the ink chamber 139 is wound in a conical trapezoid shape. With FIG. 9, the coil spring 133 is shown in a simplified state. The lower base part of the coil spring 133 abuts the first wall 71. The upper base part of the coil spring 133 abuts the surface of the pressure receiving plate 135 on the side opposite the surface of the sheet member 137 side. Also, the upper base part of the coil spring 133 abuts roughly the center part of the pressure receiving plate 135. The pressure receiving plate 135 is provided between the coil spring 133 and the sheet member 137. The pressure receiving plate 135 is formed using a synthetic resin such as polypropylene or the like, or a metal such as stainless steel or the like.

The coil spring 133 biases the pressure receiving plate 135 toward the sheet member 137 side. Said another way, the coil spring 133 biases the pressure receiving plate 135 in the Y axis negative direction. Specifically, the coil spring 133 biases the pressure receiving plate 135 in the direction that expands the capacity of the ink chamber 139.

The valve unit 131 is provided to open and close an air introduction port 171 (see FIG. 12A through 12C) for introducing air into the ink chamber 139. The sheet member 137 is joined to the case main body 121 in a state covering both the recess 61A and the valve unit 131. By doing this, the recess 61A is sealed by the sheet member 137, and at the same time, the valve unit 131 is fixed to the case main body 121. On the part of the sheet member 137 overlapping the valve unit 131, a ventilation hole 141 is formed so as not to have the air introduction port 171 become blocked.

Figure 12A:
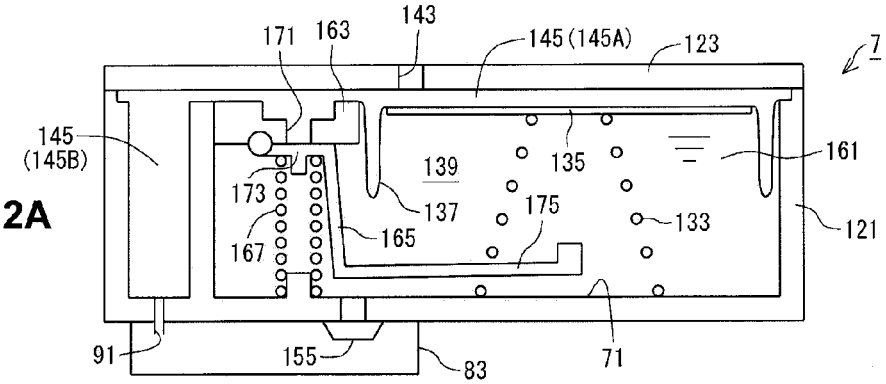
FIGS. 12A, 12B and 12C are simplified drawings showing the interior of the cartridge of the second embodiment.

As shown in FIG. 12A, the valve unit 131 includes a cover valve 163, a lever valve 165, and a spring member 167.

The air introduction port 171 is provided on the cover valve 163. The air introduction port 171 pierces through the cover valve 163. The air introduction port 171 provides communication between the chamber 139 and the air chamber 145A inside the cartridge 7A. The lever valve 165 is provided on the side of the cover valve 163 opposite to the lid member 123 side. The lever valve 165 includes a valve section 173 and a lever section 175. The valve section 173 opens and closes the air introduction port 171 of the cover valve 163. The lever section 175 extends within the area between the pressure receiving plate 135 and the first wall 71. The spring member 167 is provided on the side of the lever valve 165 opposite to the cover valve 163 side. The spring member 167 biases the valve section 173 of the lever valve 165 toward the cover valve 163 side. By doing this, as shown in FIG. 12A and FIG. 12C, the air introduction port 171 of the cover valve 163 is normally blocked by the valve section 173. As shown in FIG. 12A and FIG. 12C, the state in which the air introduction port 171 is blocked by the valve section 173 is expressed as the "closed state."

Figure 12B:
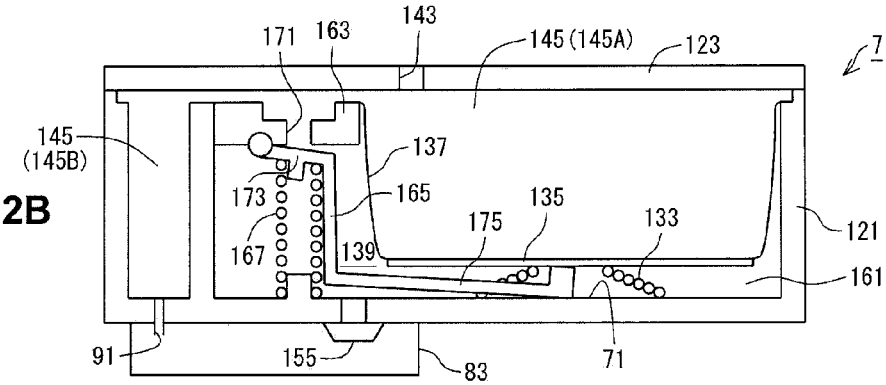
Figure 12C:
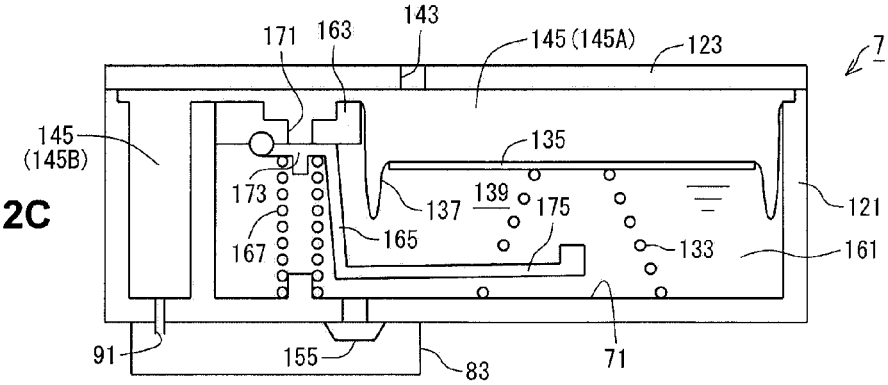

As the ink 161 inside the chamber 139 is consumed, the pressure receiving valve 135 is displaced toward the first wall 71 side as shown in FIG. 12B. At this time, the coil spring 133 is also gradually compressed by the pressure receiving plate 135, and the negative pressure inside the chamber 139 becomes larger. When the pressure receiving plate 135 is displaced to a designated position toward the first wall 71 side, the pressure receiving plate 135 pushes the lever section 175 toward the first wall 71 side. By doing this, the orientation of the lever valve 165 changes, and a gap occurs between the valve section 173 and the cover valve 163. By doing this, the air introduction port 171 and the chamber 139 are in communication. In this way, the state for which the air introduction port 171 is opened by the valve section 173 separating from the air introduction port 171 is expressed as the "open state." When in an open state, air is introduced to the interior of the chamber 139 via the through hole 143 provided on the lid member 123, the air chamber 145A on the outside of the chamber 139, and the air introduction port 171.

When air is introduced to the interior of the chamber 139, as shown in FIG. 12C, the pressure receiving valve 135 is displaced toward the lid member 123 side, is separated from the lever valve 165, and again goes to the closed state. In other words, by air flowing into the interior of the chamber 139, the capacity of the chamber 139 is greater than in the state shown in FIG. 12B. By doing this, the negative pressure inside the chamber 139 is reduced (the pressure of the chamber 139 approaches atmospheric pressure). In this way, when the negative pressure inside the chamber 139 becomes larger along with consumption of the ink 161 of the chamber 139, by the lever valve 165 temporarily going to an open state, it is possible to maintain the pressure inside the chamber 139 in a suitable pressure range.

Figure 10:
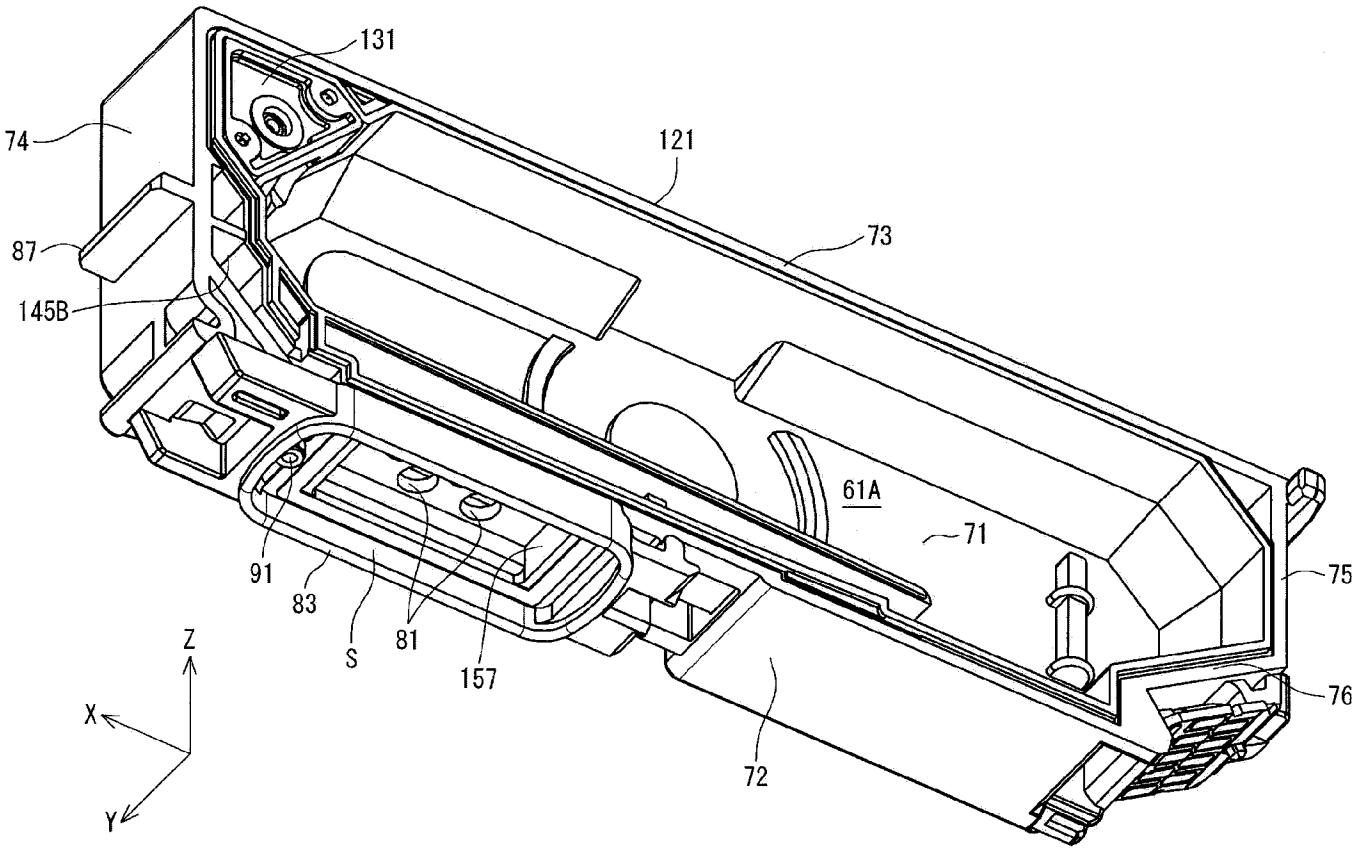
FIG. 10 is a perspective view showing the case of the second embodiment.
Figure 11:
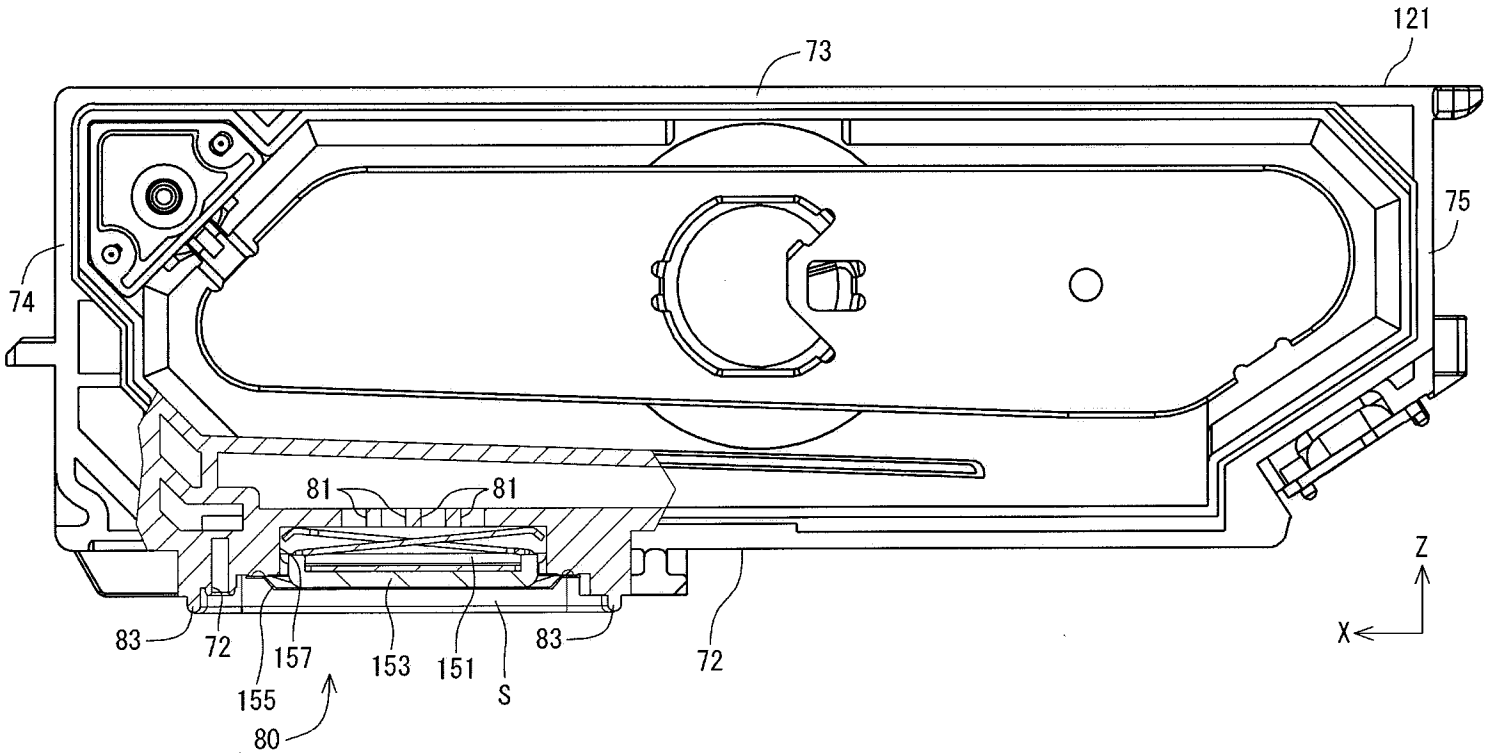
FIG. 11 is a drawing for describing the constitution of the cartridge interior of the second embodiment.

Returning to FIG. 9, we will describe an ink supply port 80A of this embodiment. With this embodiment as well, the same as with the first embodiment, the ink supply port 80A is provided on the second wall 72. The ink supply port 80A is equipped with a supply hole 81A provided so as to pierce through the second wall 72, and a peripheral wall 83 provided above the outer surface of the second wall 72. A plate spring 151, a foam 153, and a filter 155 are provided on the inside of the peripheral wall 83. With the first embodiment, the second foam 67 was fit into the supply hole 81, but with this embodiment, the plate spring 151, the foam 153, and the filter 155 are provided so as to cover the supply hole 81A from the outside. Specifically, as shown in FIG. 10, a recess 157 is provided inside the space S on the inside of the peripheral wall 83 and in the area overlapping the supply hole 81A. Then, as shown in FIG. 11, the plate spring 151 and the foam 153 are set into the recess 157. The filter 155 is attached to the second wall 72 so as to cover the recess 157 from the outside of the second wall 72. As the filter 155, for example, it is possible to use an item for which through holes are opened in a film material such as by press working or the like, an asymmetric membrane such as an MMM membrane made by PALL Corp. or the like, for example an asymmetric membrane such as woven fabric or the like.

Figure 13:
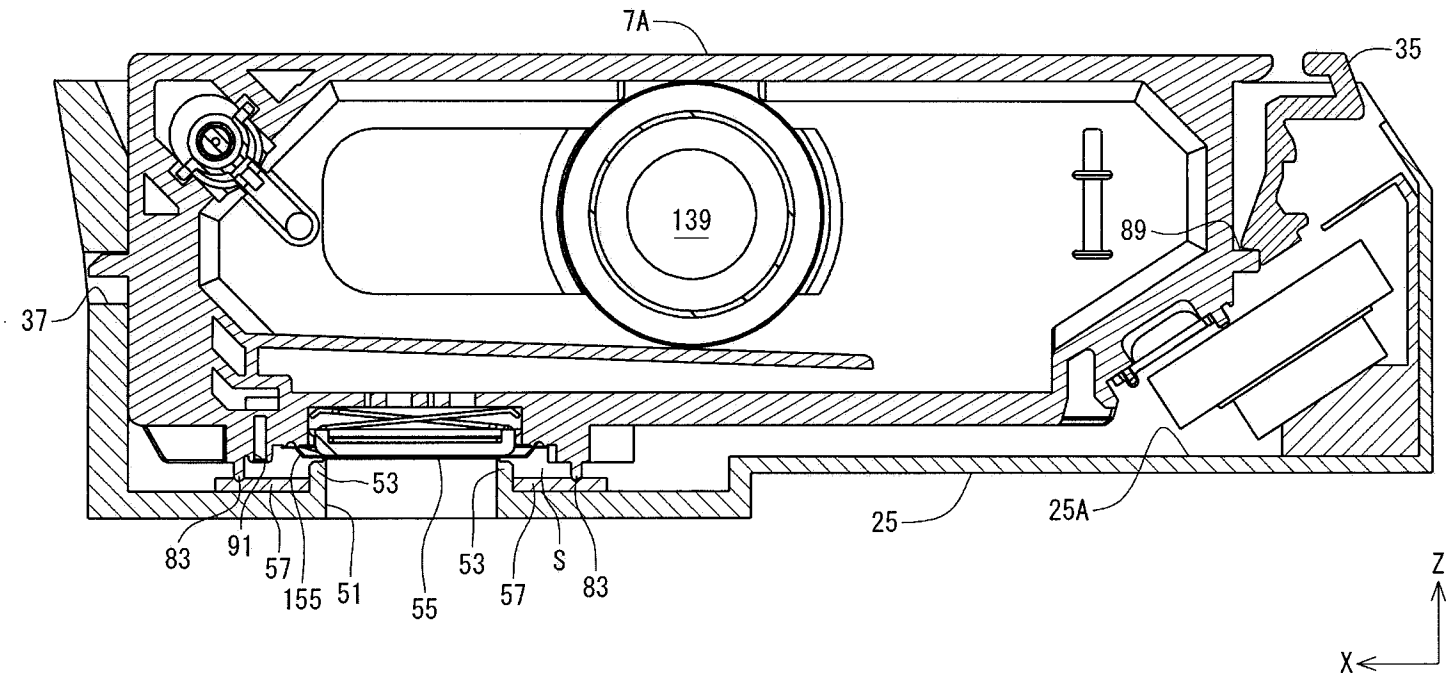
FIG. 13 is a drawing showing the state when the cartridge of the second embodiment is mounted in the holder.

As shown in FIG. 13, when the cartridge 7A of this embodiment is mounted in the holder 25, the peripheral wall 83 of the ink supply port 80 abuts the packing 57 of the printing material introduction portion 33, and the cylindrical portion 53 of the printing material introduction portion 33 is inserted inside the space enclosed by the peripheral wall 83. In other words, the peripheral wall 83 encloses the flow path 51 of the printing material introduction portion 55 from further to the outside than the cylindrical portion 53. Then, inside the space enclosed by the peripheral wall 83, the filter 155 contacts the filter 55 of the printing material introduction portion 33. By doing this, the ink housed in the ink chamber 139 is supplied to the flow path 51 via the filter 155 and the filter 55. Specifically, the filter 155 functions as the porous member for transferring ink housed in the ink chamber 139 to the printer 5 (FIG. 1).

With the second embodiment as well, the same as with the cartridge 7 of the first embodiment, the communication hole 91 is provided inside the space S on the inside of the peripheral wall 83. As shown in FIGS. 12A to 12C, the communication hole 91 is connected to the space 145B that is not sealed by the sheet member 137 of the interior of the cartridge 7A (see FIG. 9 and FIG. 10). This space 145B is connected to the air chamber 145A described previously, and is connected to outside the case 120 via the through hole 143. In other words, the inside of the space S on the inside of the peripheral wall 83 is in communication with air via the ventilation path 145 consisting of the space 14513 and the air chamber 145A. By doing this, the same as with the first embodiment, it is possible to suppress to a low level the pressure fluctuation inside the space S on the inside of the peripheral wall 83.

Also, with the second embodiment, the meniscus pressure resistance P of the filter 155 is set to a value greater than the absolute value of the difference between the pressure PA applied to the inside of the filter 155 when ink is led via the filter 155, and the pressure PB applied to inside the ventilation path 145 when ink is led via the filter 155. Specifically, with this embodiment as well, the same as with the first embodiment, the meniscus pressure P is set to a value that satisfies the relationship of formula (1) noted above. The specific examples of the meniscus pressure resistance P, the pressure PA, and the pressure PB are the same as with the first embodiment described previously. Also, the effects are also as described with the first embodiment.

Modification Example

With the embodiments noted above, the cases 60 and 120 were constituted by the case main bodies 61 and 121 constituting the first through seventh walls 71 to 77, and the lid members 63 and 123 constituting the eighth wall 78, but the constitution of the case is not limited to this. For example, it is also possible to have the third wall 73 constituted by the lid member, and to have the other walls 71, 72, and 74 through 78 constituted by the case main body. It is also possible to have the case be constituted by three or more parts. It is also not essential that the number of walls be 8. For example, it is also possible to have the case be a round pillar or elliptical pillar shape, or to have it be a rectangular solid or a cube.

Also, with the embodiments noted above, the ink supply ports 80 and 80A were provided in a state projecting to the outside from the second wall 72 of the cases 60 and 120, but the ink supply port can also be provided so as not to project from the wall of the case. Even when the ink supply port does not project from the wall of the case, if a space is formed such that the pressure fluctuates by the ink supply port being blocked, and with this kind of pressure fluctuation, the state is such that air can flow into the ink chamber or the printer via the porous member, it is possible to apply the present invention.

The present invention is not limited to an inkjet printer and its ink cartridge, and can also be applied to any printing device that sprays other printing material other than ink as well as the cartridge thereof. For example, it can be applied to the following types of printing devices and their cartridges.

Image recording devices such as facsimile devices or the like. (2) Printing devices that spray coloring material used for manufacturing color filters for image display devices such as liquid crystal displays or the like. (3) Printing devices for spraying electrode material used for forming electrodes such as of organic EL (Electro Luminescence) displays, field emission displays (FED) or the like. (4) Printing devices for spraying printing material containing bioorganic material used for biochip manufacturing. (5) A sample printing device as a precision pipette. (6) A lubricating oil printing device. (7) A resin liquid printing device. (8) A printing device for spraying lubricating oil in a pinpoint on precision machines such as watches, cameras or the like. (9) A printing device for spraying on a substrate a transparent resin liquid such as an ultraviolet curing resin or the like for forming a miniature hemispheric lens (optical lens) used for optical communication elements or the like. (10) A printing device for spraying an acid or alkaline etching fluid for etching a substrate or the like. (11) Any other printing device equipped with a printing material spray head for discharging tiny volume droplets.

The "droplets" means the state of a printing material discharged from the printing device and includes granular shapes, tear shapes, and threadlike shapes with a tail. Also, a "printing material" is acceptable as long as it is a material that can be sprayed by the printing device. For example, a substance when it is in a liquid state such as liquid state materials of high or low viscosity, as well as sol, gel water, other inorganic solvents, organic solvents, solutions, liquid resin, liquid metal (metal melt), and the like are included in "printing material." Also, this is not limited to liquids as one physical property state, but items for which particles of functional materials consisting of a solid such as a pigment, metal particles or the like are dissolved, dispersed, or blended in a solvent and the like are also included in "printing material." The "printing material" such as those noted above can also be expressed as "liquid" or "liquid body." Representative examples of liquid or liquid body printing materials include the kind of ink like that described with the embodiments noted above, liquid crystal and the like. Here, ink includes various types of liquid body compositions such as typical water based inks and oil based inks as well as gel inks, hot melt inks and the like.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

The invention claimed is:

1. A cartridge comprising:

a printing material chamber provided in an interior of a case;

a supply port that supplies printing material housed in the printing material chamber to a printing device;

a porous member that leads the printing material, the porous member provided on the supply port;

a through hole that allows the interior of the case to be in communication with the outside, the through hole provided on the case; and a ventilation path that connects a space in an interior of the supply port with the through hole, the ventilation path provided on the interior of the case, wherein a meniscus pressure resistance of the porous member is greater than an absolute value of a difference between a pressure applied to an inside of the porous member when the printing material is led via the porous member, and a pressure applied to an inside of the ventilation path when the printing material is led via the porous member.

2. The cartridge according to claim 1, wherein in the interior of the case, the printing material chamber and the ventilation path are separated from each other.

3. The cartridge according to claim 2, wherein a sheet member having flexibility is provided between the printing material chamber and the ventilation path, and the printing material chamber and the ventilation path are separated by the sheet member.

4. The cartridge according to claim 1, further comprising a ventilation hole that allows the ventilation path interior to communicate with the printing material chamber, and a valve that opens and closes the ventilation hole, wherein the valve is constituted so as to normally close the ventilation hole, and to separate from the ventilation hole only when a capacity of the printing material chamber is decreased to a prescribed value, and air on the interior of the ventilation path is introduced into the printing material chamber when the valve is separated from the ventilation port.

5. The cartridge according to claim 1, wherein on an inside of the printing material chamber, a second porous member that holds the printing material is provided in a state with a gap open in relation to at least a portion of a wall demarcating the printing material chamber, and the ventilation path is constituted by the gap inside the chamber, and a second meniscus pressure resistance of the second porous member is the same or greater than a sum of a pressure applied to an inside of the second porous member when the printing material is led from the supply port, and a pressure applied to the gap when the printing material is led from the supply port.

* * * * *